US007748653B2

(12) United States Patent
Palm

(10) Patent No.: US 7,748,653 B2
(45) Date of Patent: Jul. 6, 2010

(54) METHOD AND APPARATUS FOR TREATING MATERIALS OR MIXTURES OF MATERIALS

(75) Inventor: Carl-Olof Palm, Turku (FI)

(73) Assignee: Fractivator Oy, Tarttila (FI)

( * ) Notice: Subject to any disclaimer, the term of this patent is extended or adjusted under 35 U.S.C. 154(b) by 245 days.

(21) Appl. No.: 11/664,686

(22) PCT Filed: Sep. 21, 2005

(86) PCT No.: PCT/FI2005/000396

§ 371 (c)(1),
(2), (4) Date: Apr. 5, 2007

(87) PCT Pub. No.: WO2006/040391

PCT Pub. Date: Apr. 20, 2006

(65) Prior Publication Data

US 2008/0179434 A1 Jul. 31, 2008

(30) Foreign Application Priority Data

Oct. 13, 2004 (FI) ..... 20041326

(51) Int. Cl.
*B02C 17/16* (2006.01)
*B02C 13/00* (2006.01)

(52) U.S. Cl. ..... 241/27; 241/188.1

(58) Field of Classification Search ..... 241/27, 241/188.1, 188.2, 186.5
See application file for complete search history.

(56) References Cited

U.S. PATENT DOCUMENTS

| | | | | |
|---|---|---|---|---|
| 3,062,457 | A * | 11/1962 | Willems | 241/1 |
| 3,815,835 | A * | 6/1974 | Apostol et al. | 241/188.2 |
| 4,011,027 | A * | 3/1977 | Selder | 415/121.3 |
| 4,691,867 | A * | 9/1987 | Iwako et al. | 241/21 |
| 4,813,619 | A * | 3/1989 | Tjumanok et al. | 241/80 |
| 5,904,308 | A * | 5/1999 | Schnell | 241/188.2 |
| 6,202,946 | B1 | 3/2001 | Virtanen | |
| 6,719,454 | B1 | 4/2004 | Bacher et al. | |
| 6,843,886 | B1 | 1/2005 | Huovinen et al. | |
| 2004/0188480 | A1 | 9/2004 | Palm et al. | |
| 2006/0011757 | A1 | 1/2006 | Palm | |

FOREIGN PATENT DOCUMENTS

| | | |
|---|---|---|
| DE | 3138259 | 4/1983 |
| EP | 0 506 638 | 9/1992 |
| FI | 922306 | 5/1992 |
| GB | 1166059 | 10/1969 |
| SU | 803973 | 2/1981 |

* cited by examiner

*Primary Examiner*—Faye Francis
(74) *Attorney, Agent, or Firm*—James C. Lydon

(57) ABSTRACT

A method and apparatus for treating materials or material mixtures in a treatment apparatus operating on the principle of the double-action impact mill, which includes a discharge conveyor (34), such as a discharge screw. A material layer (40) is maintained between the discharge opening and the discharge conveyor, using the material exiting the outermost ring (16") of the treatment apparatus through the discharge opening (30), which layer prevents free discharge of the material to be treated from the treatment apparatus.

21 Claims, 2 Drawing Sheets

METHOD AND APPARATUS FOR TREATING MATERIALS OR MIXTURES OF MATERIALS

The present invention relates to a method and apparatus according to the preambles of the independent claims presented later in this patent application for treating different materials or material mixtures containing mineral substance, fiber mass, recycled fiber, other rejects, waste or biomass.

BACKGROUND OF THE INVENTION

Previously, it has been common to treat a wide variety of materials and material mixtures using an apparatus operating on the principle of a double-action impact mill which functions, for example, as a very efficient grinder or mixer. The apparatus has been presented earlier in the Finnish patent publications FI 94030 B, FI 105112 B and FI 105699 B, and in the PCT publication WO 96/18454.

Apparatuses operating on the principle of a double-action impact mill can be used for treating a wide variety of solid substances or mixtures containing solid matter. The apparatuses can be used, for example, for grinding and sludging mineral substances and fiber-rich materials, for defragmenting substances containing various biomaterials prior to their biological decomposition, or for mixing sludges, pastes and doughs.

The dwell-time of the material to be treated in an apparatus operating on the principle of a double-action impact mill is very short, often less than 0.1 seconds, which is advantageous in many processes. In some cases, however, the dwell-time may be too short for a desired treatment. In such cases, the treated material must be handled-further in a separate additional treatment stage.

A separate additional treatment may be necessary, for example, in order to improve the desired effect of the chemicals that are added to the material to be treated. This is the case, for example, when the chemical added to the material lacks enough time to become absorbed into the substance in the double-action impact mill.

It is easy to treat materials with a very high dry matter content and/or high viscosity in an apparatus operating on the principle of a double-action impact mill. It may, however, be difficult to discharge the treated material with a very high dry matter content and/or high viscosity from the apparatus, and to transport it to the next process stage. An improved result has been achieved by treating the material in two or several sequential apparatuses operating on the principle of a double-action impact mill, in which case it has been possible to lower the viscosity to a superior level. When considering the entire process it would be advantageous, however, if additional further treatments were not necessary at all, or if they could be substantially shortened.

A solution for the material discharging problem from the grinder, operating on the principle of a double-action impact mill, has been suggested in the Finnish patent FI94030. It is essential for the solution, that the material to be treated does not fill the apparatus completely at any stage, i.e. the material remains discontinuous and is surrounded by air at all times. The material content of the apparatus is kept continuously small. This is accomplished by allowing the rotors to rotate at high speeds, by scraping all the material from the walls of the apparatus, and discharging all the scraped material immediately from the apparatus through a relatively large discharge opening. A tangential discharge pipe has been fitted at the discharge opening, where it is also possible to fit an open helix-screw. The discharge opening of the apparatus is increased in size, even to over 90% of the outermost ring of the apparatus. The purpose is thus to ensure that all the material is easily and completely discharged from the apparatus as soon as it encounters the discharge opening.

SUMMARY OF THE INVENTION

The purpose of the present invention is to present an improved method and apparatus for treating materials or material mixtures containing mineral substances, fiber mass, recycled fiber, other rejects, waste or biomass. The material is typically treated in an apparatus operating on the principle of a double-action impact mill or the like.

The purpose is thus to present a method and apparatus which make it possible to increase the dwell-time of the material to be treated in an apparatus operating on the principle of a double-action impact mill or the like.

The purpose is also to present a method and apparatus which makes an efficient additional treatment of the material possible.

Moreover, the purpose is to present a method and apparatus which makes it possible to decrease essentially the need for further treatment after the apparatus operating on the principle of a double-action impact mill or the like.

In addition, the purpose is also to present a method and apparatus which enables treatment of material with a higher dry matter content than earlier in the apparatus operating on the principle of a double-action impact mill or the like.

In order to achieve the objectives presented above, a method and apparatus according to the invention are characterized in that which is presented in the characterizing parts of the independent claims presented later in this patent application.

A typical apparatus according to the invention comprises a known device operating on the principle of a double-action impact mill or the like.

This apparatus typically comprises

- a housing or the like which contains a feed opening, and at least one discharge opening in association with the outermost ring of the housing,
- a first rotor fitted inside the housing, equipped with blades, pins or the like with impact surfaces, and which blades or the like form one or several, typically at least two, coaxial rings with the said rotor, and
- a stator, which is coaxial with the first rotor, or a rotor, coaxial with the first rotor, rotating in different direction or at different speed, fitted inside the housing, which stator or the second rotor are equipped with blades, pins or the like with impact surfaces, and which blades or the like form one or several, typically at least two, coaxial rings with the said stator or the second rotor, which rings are staggered with the ring or the rings of the first rotor.

The material to be treated is fed in to the treatment apparatus through a feed opening, into the hub formed of blade rings, wherefrom some of the material to be treated is transported by the effect of the rotor or rotors to the outermost ring of the rings formed of outer blades, and is discharged from the treatment apparatus through a discharge opening located in the housing. The material discharged from the housing is transported further to the next process stage using a discharge conveyor, typically a discharge screw.

In the apparatus according to the invention there is a space, typically a small restricted space, between the discharge opening and the discharge conveyor of the treatment apparatus, in which space such a material layer is formed and maintained from the material being discharged from the treatment apparatus, that it prevents the material to be treated from exiting freely from the treatment apparatus. This material layer reaches the discharge opening, and thus prevents the substance to be treated in being discharged freely through the discharge opening. The material layer operates as a delay element formed of a moving material, and restricts all the material reaching the discharge opening and being discharged from the treatment apparatus.

Material is, however, continuously discharged from the material layer to the discharge conveyor. Correspondingly, just the same amount of material is allowed to be transported through the discharge opening from the outermost ring of the treatment apparatus to the material layer, the rest of the material reaching the discharge opening must bypass the discharge opening without being discharged from the apparatus. Thus, the material layer brakes, delays or otherwise adjusts, but does not completely prevent, the material from being discharged from the treatment apparatus. The amount of the material flowing through the material layer, i.e. the material flowing to the discharge conveyor from the treatment apparatus, can be adjusted by controlling the transport of the material from the material layer to the discharge conveyor. The amount of the material to be discharged from the treatment apparatus can be adjusted by controlling the operation of the discharge conveyor. The operation of the discharge conveyor can be adjusted using control elements. When a discharge screw is being used, for example, control elements, which either increase or decrease the rotation speed of the screw so that the desired filling level is achieved in the treatment apparatus, can be used.

Now, it has been surprisingly discovered that by maintaining the material layer between the discharge opening and the discharge conveyor formed of the material to be discharged from the treatment apparatus, the amount of the material flowing through this layer can be controlled by adjusting the dwell-time or the filling level of the material in the treatment apparatus. At the same time, it is possible to adjust the material treatment or process time in the treatment apparatus.

By increasing the through-flow through the material layer, the dwell-time and the filling level of the material in the treatment apparatus is decreased. Correspondingly, by decreasing the through-flow through the material layer, the dwell-time and the filling level of the material in the treatment apparatus is increased. By increasing the dwell-time and the filling level, it is possible to better exploit the efficiency of the apparatus than previously.

Thus, in the apparatus according to the invention, only part of the material transported to the discharge opening by the ring blades is able to exit through the discharge opening. The remaining-material transported by the blades to the discharge opening is arranged to bypass the discharge opening without leaving the outermost ring.

Typically 10-90%, more typically 30-70%, of the material reaching the discharge opening of the outermost ring is allowed to be discharged through the opening to the material layer, and further to the discharge conveyor. Thus, typically 90-10%, more typically 70-30% of the material bypasses the discharge opening without leaving the treatment apparatus.

The material reaching the discharge opening on the outermost ring is typically allowed to bypass the discharge opening without leaving the treatment apparatus until the dwell-time of the material flowing through the treatment apparatus is 1.1-10 times, typically 2-6 times, longer than the dwell-time in the corresponding conventional treatment apparatus in which the material is allowed to be discharged freely through the discharge opening. An average dwell-time can thus, for example, be >1 second in processes in which the dwell-time typically is clearly less than 1 second, even less than 0.1 seconds.

The apparatus according to the invention can be used to replace the conventional apparatus operating on the principle of a double-action impact mill, especially when a longer handling time, i.e. more efficient treatment, is desired.

The apparatus according to the invention makes it possible to treat a wide variety of materials or material mixtures such as solid substances, solid substance mixtures, mixtures of solid substances and liquids, liquids or mixtures of solid substances and gas.

The apparatus according to the invention is also well suited to be used for treating materials which have especially high dry matter content or high viscosity, but it also may be used for treating liquid materials.

The apparatus according to the invention can be used for treating a wide variety of materials containing solid matter such as mineral substances, for example, for grinding, mixing and/or sludging pigments, recycled fiber or other fiber mass, various rejects and waste, and various biomasses such as chips, straw, hay, peat, vegetables, foodstuff and slaughter waste. Thus, the apparatus according to the invention is well suited for use in the paper industry for sludging coating slip or for deinking recycled fiber.

The invention can be applied in apparatuses operating in the principle of a double-action impact mill which are used as grinders, mixers, dispersers or fragmentators. On the other hand, the apparatus can also be used to mix various additives such as chemicals into the solid substance or mixture of solid substances. The apparatus can also be used to bring various substances into contact with each other.

BRIEF DESCRIPTION OF THE DRAWINGS

The invention shall now be described in more detail with reference to the attached figures, which are presented only in the form of an example, in which

FIG. 1 and FIG. 2 present a typical apparatus applied by the invention which comprises a treatment apparatus operating on the principle of a double-action impact mill, and a discharge screw connected to the apparatus. The screw is presented only in FIG. 2. The apparatus can be used, for example, for sludging mineral substances such as different pigments when producing a coating slip in the paper mill.

DETAILED DESCRIPTION OF THE EMBODIMENTS

Figure 1:
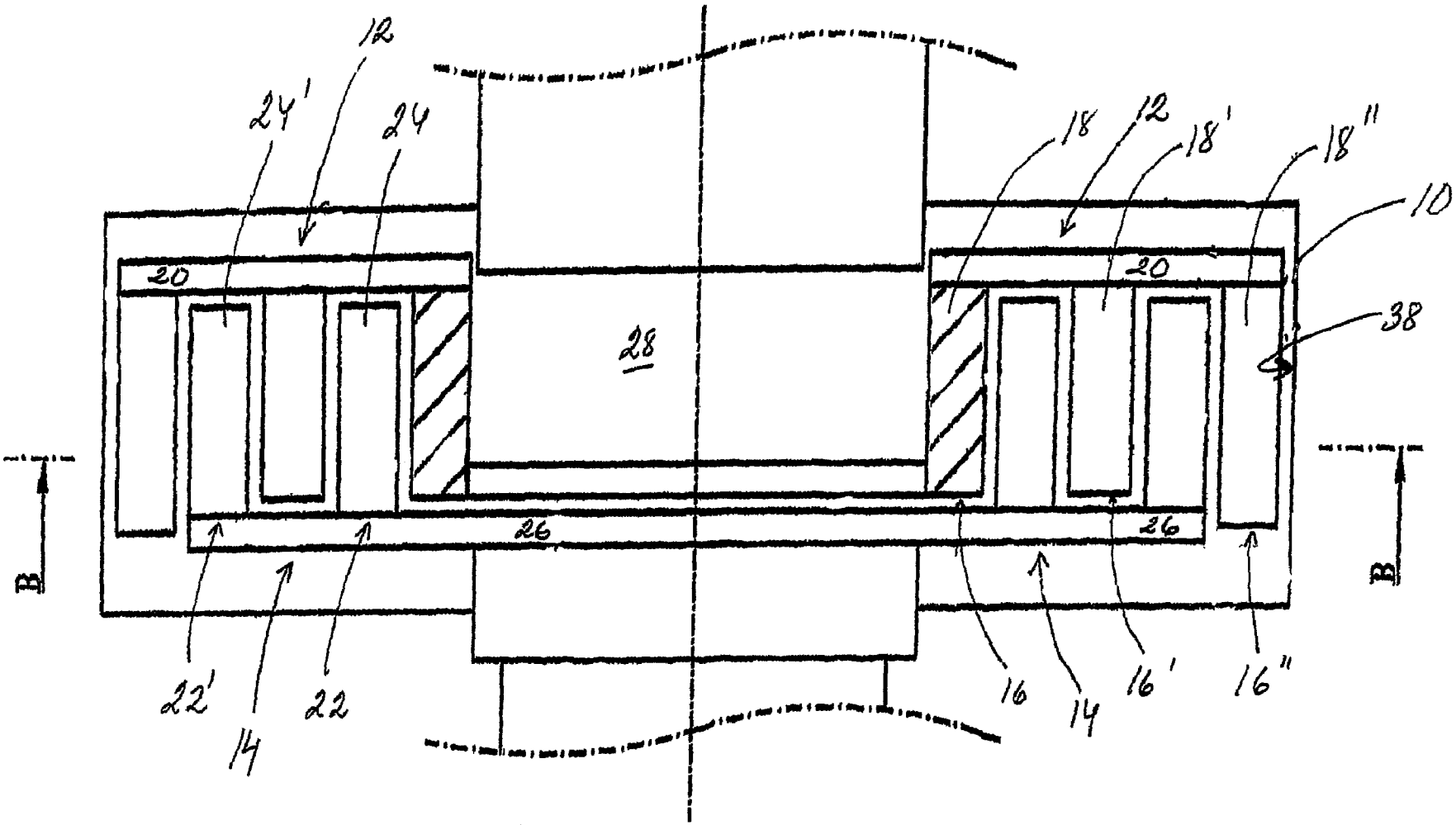
FIG. 1 illustrates schematically a vertical cross-section of an apparatus applied in an embodiment of the invention, equipped with five rings, and operating on the principle of a multi-ring double-action impact mill, taken from the cross section AA of the apparatus presented in FIG. 2.

The treatment apparatus comprises a housing 10, inside of which two coaxial rotors 12 and 14 are fitted which, in the case presented as an example, rotate in opposite directions. In the solution according to the invention, the rotors can be arranged to rotate in the same direction but then their difference in speed must be relatively large. On the other hand, in the solution according to the invention, the other rotor can even be replaced by a stator.

Blades 18, 18' and 18" have been fitted on the three rings 16, 16' and 16" of the first rotor 12, whose rings are coaxial with the rotors, but are located at different distances from the center axel; and whose blades are attached to the body 20 of this rotor from their first ends. Correspondingly, blades 24, 24' have been fitted on two rings 22, 22' of the second rotor 14, whose rings are coaxial with the rotors but are located at different distances from the center axel; and whose blades are attached to the body 26 of this rotor from their first ends. The blades of the second rotor are arranged to move between the rings formed by the blades of the first rotors. The rings formed of different rotor blades are thus staggered. Moreover, the blades can be connected from their other ends to support rings located in corresponding rings or other corresponding support elements, which, however, have not been presented in the figure.

The housing is equipped with a feed opening 28 located in the hub of the rotors, through which the material to be treated, and another possible substance to be added, is fed in to the apparatus. The housing is also equipped with, at least, one discharge opening 30 associated with the outermost ring of the rotor, such that the collision speed of the rotors with the material is highest.

The rotors 12 and 14 rotating in different directions transport the material which is to be treated, such as mineral substance, possible water needed for sludging and chemicals possibly needed, by the effect of centrifugal force through a zigzag path to the outermost ring of the rotors. The zigzag path is illustrated schematically in FIG. 2 as small arrows n and n'. The treated material, the sludge, is discharged from the outermost ring tangentially through the discharge opening 30.

The blades 18, 18', 18" have impact surfaces a, a', a" on their front side. Correspondingly, the blades 24, 24' have impact surfaces b, b' on the front side of their direction of motion. The material to be treated, which has been fed in to the apparatus, collides first with the impact surfaces a of the blades 18 which fling the material diagonally outwards so that the material encounters the impact surfaces b of the blades 24 moving in opposite direction, and is further transported diagonally in another direction as the arrows n-n' indicate. Thus the material is thrown by the effect of impact surfaces ring by ring towards the outermost ring 16' of the rotors, where the material collides with wall 38 of the housing, from where the treated material is taken, using the blades 18" as scrapers, towards the discharge opening 30 of the housing, and finally out through it.

When travelling through the treatment apparatus, the material collides with the impact surfaces of each ring in question at a high kinetic energy. The rotors 12, 14 rotating in opposite directions at great, 300-3000 l/min, typically about 1600 l/min, speeds, generate, in addition to efficient treatment, grinding, defragmenting or corresponding treatment, a strong centrifugal force, which maintains an efficient flow from the inlet opening 28 towards the housing wall 38.

The blades 18" fitted on the outermost ring 16" of the first body section 20 act as scrapers which transport the material, gathered at the outer ring area, towards the discharge opening 30.

A discharge pipe 32 along which the treated material is directed out of the apparatus is fitted tangentially outside the discharge opening 30 in association with a discharge opening. A discharge conveyor is fitted in the discharge pipe, in this case a discharge screw 34, which leads the material away from the front of the discharge opening. The discharge screw 34 is adjusted to discharge the material at the discharge opening so that there is a continuous material layer 40 between the discharge opening and the discharge screw, which prevents free discharge of the material through the discharge opening i.e. it prevents the material in being discharged freely from the outermost ring of the treatment apparatus. The discharge screw is selected so that it discharges material suitably from the apparatus. The diameter of the discharge screw can even be 500 mm, and the length 0.5-2 m. When necessary, the discharge screw can be a different size, either smaller or larger.

The material layer 40 is formed between the reach area of the blades of the outermost ring and the reach area of the discharge screw, in other words, between the operating areas of the blades and the screw. This space can be very short, typically only 5-10 mm, but it can also be smaller or substantially larger.

When using the solution according to the invention, it is possible to force some of the material 36 gathered at the outermost ring 16" to bypass the discharge opening without leaving that ring, and thus this material is made to continue cycling in the apparatus for another or several rounds in which case the material to be treated has a longer dwell-time, i.e. the treatment is longer.

Figure 2:
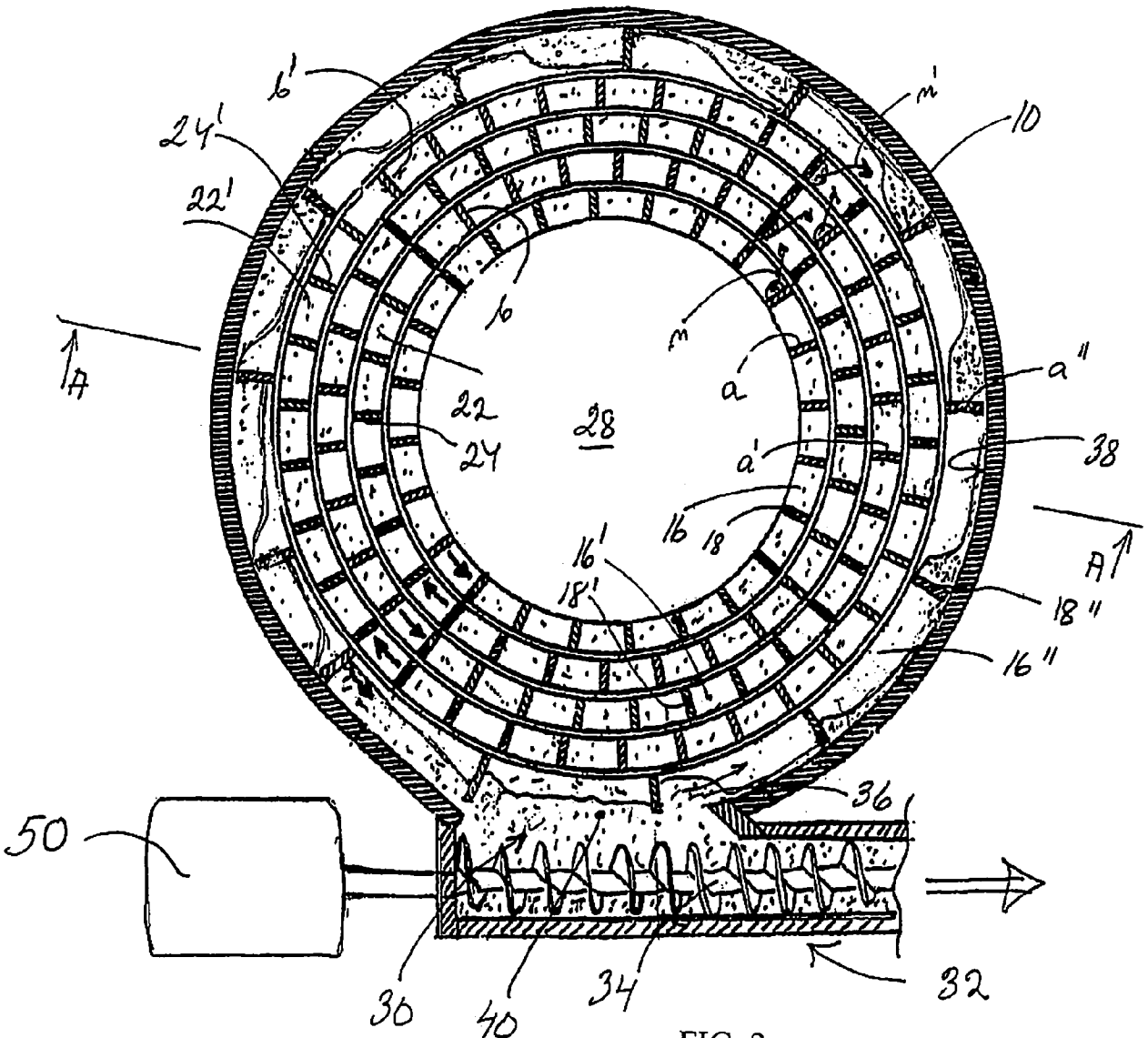
FIG. 2 illustrates schematically a horizontal cross-section of an apparatus, taken from the cross-section BB of the apparatus presented in FIG. 1.

By adjusting the discharge screw 34 it is possible to influence the filling level of the treatment apparatus and the dwell-time of the material, i.e. the treatment time. Referring to FIG. 2, control elements 50 control the rotation speed of discharge screw 34. Discharge of the material is adjusted by a discharge screw 34 so that a suitable amount of the material on the outermost ring is discharged when reaching the discharge opening, whereas the rest remains in the treatment apparatus.

When less material is discharged from the material layer 40 in front of the discharge opening using a discharge screw, the material flow out of the apparatus also decreases automatically in which case the filling level, as well as the dwell-time of the material of the treatment apparatus increases. Correspondingly, when more material is discharged from the material layer 40 in front of the discharge opening using the discharge screw, the outflow of the material automatically increases from the treatment apparatus, in which case the filling level of the treatment apparatus decreases, as well as the dwell-time and the treatment time of the material in the treatment apparatus. By adjusting the revolution of the discharge screw, it is thus easy to adjust the treatment of the material to be well-suited for the purpose.

The discharge opening can, in the treatment apparatus according to the invention, be smaller than in corresponding ordinary treatment apparatuses in which the opening can be even more than 90° of the housing ring. Using a smaller discharge opening, it is easier to maintain a desired material layer 40 in front of the discharge opening. The discharge opening presented in FIG. 2 covers less than 90° (even less than 30°) of the ring of the housing 10.

FIG. 2 illustrates a case, in which only a very small amount of the material bypasses the discharge opening without leaving the apparatus. In this case, only a very small amount of the material travels twice on the outermost ring 16". A substantially larger amount of the material can be directed to bypass the discharge opening to make another round, even such an amount that the whole outermost ring is filled with the material. If even more material cycles through the apparatus, the second outermost ring 22' will also be filled with the material, which substantially increases the power consumption of the motor driving the ring in question.

Longer dwell-time forces the material on the outermost ring 16" to rotate and grind against the housing wall 38 and blades 18", which mixes and grinds the material, and thus increases the effective output which is the purpose of the longer dwell-time. The longer dwell-time also increases the shear forces affecting the material during the treatment.

The longer dwell-time is useful, for example, in such treatments of materials, where an additive is mixed to the material to be treated. The additive may be a solid substance, liquid or gas. The longer dwell-time enables better mixing, absorption or dissolution of an additive. The longer dwell-time gives both the material to be treated and the additive a longer time to act. Thus, for example, the grinding result may be better, better sludge is achieved, or another improvement depending on the treatment.

The solution according to the invention improves many processes. By applying the invention, it is possible, for example, to treat substances with a higher dry matter content more efficiently than previously. By applying the invention, it is also possible to shorten the time needed for further treatments, in many processes, where further handling of the material is necessary after the actual treatment. For example, by applying the invention when producing a pigment sludge used for paper coating, it is possible to shorten the final mixing, agitation, after the actual sludging process, to half, in which case the whole manufacturing process shortens.

The apparatus according to the invention is well suited for sludging various pigments for producing a coating slip used in the paper industry. In this case, a suitable amount of pigment, water and necessary chemicals, such as a binding agents, are continuously fed in to the apparatus operating on the principle of a double-action impact mill, in which the dwell-time has been increased. When applying the invention, it is possible to sludge the pigment in a substantially higher dry matter content than previously, even in 75-80% DMC. When treating rejects or in deinking or using another corresponding paper industry process, in which the sludge contains about 1-2% fibers, the invention can be applied for sludges, whose dry matter content is as high as 15-20%. By increasing the dwell-time of the pigment to be treated in the apparatus, it is possible to decrease the viscosity of the formed pigment sludge, it can be even 300-600 m Pas (Brookfield) lower than without the increased dwell-time. The viscosity of the pigment sludge produced in a traditional apparatus can be as high as 1000 m Pas. By applying the invention, it is possible to lower the viscosity of the same pigment sludge to 500 m Pas. The pigment sludge, which is a tough paste when treated in a traditional way, is thus made easier to handle and transport. The longer dwell-time also decreases the need for further treatment, agitation. The further treatment can be accomplished in an ordinary mixer or another apparatus operating on the principle of a double-action impact mill. In further treatment, the viscosity is further lowered to the desired level.

The invention can be applied in the treatment of a wide variety of materials and material mixtures, including different mineral substances, fiber masses, masses containing recycled fiber or other rejects, or waste and biomasses including fresh and dried masses.

Advantages of the invention include, for example:

shorter treatment time, less need for further treatment, more efficient treatment, as the dwell-time and treatment time are longer, better final results, such as better mixing, more complete treatment and lower viscosity, improved treatment apparatus efficiency and adjustability.

In addition, special advantages include, that the apparatus can be structured so tight that the treated material can be fed in to a pressurized space using a discharge screw.

When desired, it is possible to arrange water discharge into the discharge pipe, which enables removal of water from the liquid containing material, and thus the dry matter content of the treated material is higher when discharged. For example, small discharge openings, which enable liquid removal, can be arranged at the discharge pipe, typically at its bottom, or a mesh, allowing the water to go through, can be fitted at a suitable area of the pipe. On the other hand, it is possible to fit a mesh or the like around the screw, advantageously at least at the end of the screw, so that the water can be removed in different directions from the material transported by the screw.

When in the apparatus according to the invention sludgy, water containing materials are treated, it might be advantageous to tilt the treatment apparatus, i.e. arrange it slanted so that the treated material may flow down towards the discharge screw.

The invention is not intended to be limited to the embodiment presented as an example above; on the contrary, it is intended that the invention be broadly adapted within the scope of the claims presented below.

The invention claimed is:

1. A method for treating materials or material mixtures in an apparatus which comprises a treatment apparatus operating on the principle of a double-action impact mill which comprises a housing with a feed opening, and at least one discharge opening, a first rotor fitted inside the housing, equipped with blades having impact surfaces wherein said blades form one or several coaxial rings with said rotor, and a stator, which is coaxial with the first rotor, or a second rotor, coaxial with the first rotor, fitted inside the housing, wherein said stator or the second rotor are equipped with blades having impact surfaces wherein said blades form one or several coaxial rings with said stator or the second rotor, wherein said rings are staggered with the ring or rings of the first rotor, and wherein said discharge opening is in association with an outermost ring, and a discharge conveyor, and wherein said method includes the following steps feeding material to be treated through the feed opening, into a hub of the treatment apparatus, formed of ring blades, from where the material to be treated is transported by the effect of the rotor or rotors, through the rings formed by said blades, to said outermost ring, and is discharged from the treatment apparatus through said discharge opening located in the housing at a location where the collision speed of the ring blades with the material is highest, and transporting the material discharged from the housing by said discharge conveyor, wherein from the material exiting from the outermost ring through the discharge opening, a material layer is maintained between the discharge opening and the discharge conveyor, which material layer prevents a free discharge of the material to be treated through the discharge opening from the treatment apparatus.

2. The method according to claim 1, wherein discharge of the material from the treatment apparatus through the discharge opening is controlled using a discharge conveyor, by adjusting the material flow from the material layer to the discharge conveyor.

3. The method according to claim 1, wherein part of the material on the outermost ring entering at the discharge opening, is allowed to be discharged through the discharge opening to the material layer, and onwards to the discharge conveyor, and the rest is allowed to bypass the discharge opening without leaving the treatment apparatus.

4. The method according to claim 3, wherein material entering the discharge opening on the outermost ring is allowed to bypass the discharge opening without leaving the treatment apparatus until a dwell-time of the material flowing through the treatment apparatus is 1.1-10 times longer than the dwell-time in a treatment apparatus which allows the material be discharged freely through the discharge opening.

5. The method according to claim 4, wherein material entering the discharge opening on the outermost ring is allowed to bypass the discharge opening without leaving the treatment apparatus until the dwell-time of the material flowing through the treatment apparatus is 2-6 times longer than the dwell-time in a treatment apparatus which allows the material be discharged freely through the discharge opening.

6. The method according to claim 3, where 10 to 90% of the material on the outermost ring entering at the discharge opening, is allowed to be discharged through the discharge opening to the material layer, and 90 to 10% is allowed to bypass the discharge opening without leaving the treatment apparatus.

7. The method according to claim 3, where 30 to 70% of the material on the outermost ring entering at the discharge opening, is allowed to be discharged through the discharge opening to the material layer, and 70 to 30% is allowed to bypass the discharge opening without leaving the treatment apparatus.

8. An apparatus for treating materials or material mixtures according to the method of claim 1, which apparatus comprises a treatment apparatus operating on the principle of the double-action impact mill, which comprises a housing, fitted with a feed opening, and at least one discharge opening, a first rotor fitted inside the housing, equipped with blades with impact surfaces wherein said blades form one or several coaxial rings with said first rotor, and a stator which is coaxial with the first rotor, or a second rotor, coaxial with the first rotor, fitted inside the housing, wherein said stator or the second rotor are equipped with blades having impact surfaces wherein said blades form one or several coaxial rings with said stator or the second rotor, wherein said rings are staggered with the ring or rings of the first rotor, wherein said discharge opening is associated with an outermost ring such that discharge of treated material occurs at a location where the collision speed of the ring blades with the material is highest, said apparatus further comprising a discharge conveyor, wherein there is a space between the discharge opening and the discharge conveyor of the treatment apparatus said space adapted to maintain a material layer between the discharge opening and the discharge conveyor to prevent free discharge of the material to be treated from the treatment apparatus through the discharge opening.

9. The apparatus according to claim 8, further comprising control elements connected to the discharge conveyor and which control movement of the material from the material layer to the discharge conveyor.

10. The apparatus according to claim 8, wherein the discharge conveyor is a discharge screw.

11. The apparatus according to claim 10, wherein a distance between the discharge screw and the blades of the outermost ring is 5-10 mm.

12. The apparatus according to claim 8, wherein the discharge opening covers less than 90° of the outermost ring.

13. The apparatus according to claim 12, wherein the discharge opening covers less than 30° of the outermost ring.

14. The apparatus according to claim 8, wherein the rotors, material layer and the discharge screw are fitted in a closed space, from which the treated material can be fed into a pressurized space.

15. The apparatus according to claim 8, wherein the blades of said first rotor form at least two coaxial rings with the first rotor, and the blades of said stator or second rotor form at least two coaxial rings with said stator or second rotor.

16. The apparatus of claim 8, wherein said materials are selected from the group consisting of materials containing a mineral substance, fiber mass, recycled fiber, waste and biomass.

17. The apparatus of claim 8, wherein the impact surfaces of said blades of said apparatus are all in the same horizontal plane.

18. The method according to claim 1, wherein the blades of said first rotor form at least two coaxial rings with the first rotor, and the blades of said stator or said second rotor form at least two coaxial rings with said stator or said second rotor.

19. The method according to claim 1, wherein said discharge conveyor is a discharge screw.

20. The method of claim 1, wherein said materials are selected from the group consisting of materials containing a mineral substance, fiber mass, recycled fiber, waste and biomass.

21. The method of claim 1, wherein the impact surfaces of said blades of said apparatus are all in the same horizontal plane.

* * * * *